US005771711A

United States Patent [19]

Kubota

[11] Patent Number: 5,771,711

[45] Date of Patent: Jun. 30, 1998

[54] HIGH-TEMPERATURE REGENERATOR

[75] Inventor: Norikazu Kubota, Ohra-gun, Japan

[73] Assignee: Sanyo Electric Co., Ltd., Osaka-fu, Japan

[21] Appl. No.: 807,548

[22] Filed: Feb. 28, 1997

[51] Int. Cl.[6] ..... F25B 33/00; F22B 7/00

[52] U.S. Cl. ..... 62/497; 122/155.2

[58] Field of Search ..... 62/476, 101, 497; 122/155.2, 155.3

[56] References Cited

U.S. PATENT DOCUMENTS

| | | | |
|---|---|---|---|
| 4,548,048 | 10/1985 | Reimann et al. | 62/238.3 |
| 4,617,870 | 10/1986 | Hirano et al. | 110/323 |
| 4,926,659 | 5/1990 | Christensen et al. | 62/476 |
| 5,263,340 | 11/1993 | Sekoguchi et al. | 62/497 |
| 5,435,154 | 7/1995 | Nishiguchi et al. | 62/476 |
| 5,546,760 | 8/1996 | Cook et al. | 62/497 |

FOREIGN PATENT DOCUMENTS

| | | | |
|---|---|---|---|
| 112904 | 4/1941 | Australia | 62/497 |
| 62-10355 | 3/1987 | Japan . | |

*Primary Examiner*—William Doerrler
*Attorney, Agent, or Firm*—Weingarten, Schurgin, Gagnebin & Hayes LLP

[57] ABSTRACT

In a high-temperature regenerator for an absorption type refrigerator in which combustion in a combustion furnace 21 for heating a working medium is completed and an unburnt gas is hardly exhausted, a group 27 of pipes 29 for passing the working medium are arranged in the combustion furnace 21, a combustion gas flow 37 from a combustion burner 31 is caused to run through the group 27 of pipes, and a first and a second partition plates 41 and 43 are disposed in a high-temperature region 39 of the combustion gas flow 37 to cause the combustion gas flow 37 to make a loop detour and stay therein, thereby promoting combustion.

1 Claim, 6 Drawing Sheets

HIGH-TEMPERATURE REGENERATOR

BACKGROUND OF THE INVENTION

1. Field of the Invention

This invention relates to a high-temperature regenerator for an absorption type refrigerator.

2. Background Art

In an absorption type refrigerator (including a so-called absorption heat pump or absorption type water cooling or heating machine), an absorption solution which has absorbed a refrigerant is used as a working medium circulating inside. There are a plurality of combinations of refrigerants and absorption solutions. For example, they include a combination of water as the refrigerant and lithium bromide as the absorption solution and a combination of ammonia as the refrigerant and water as the absorption solution. In either case, the working medium is heated by a burner in a high-temperature regenerator which constitutes part of the absorption type refrigerator and the refrigerant absorbed in the absorption solution is evaporated so that the both materials are separated and regenerated to be prepared for the next cycle.

There are various types of high-temperature regenerators for heating with a burner. They include, for example, one in which a plurality of gas pipes through which a combustion gas from a combustion burner flows are arranged in a tank containing a working medium and the working medium is heated by heat from the smoke pipes. Another example is that pipes through which a working medium circulates are arranged in a combustion furnace, spaced apart from one another and a combustion gas from a combustion burner flows between the pipes.

An example of the latter type of high-temperature regenerator (Japanese Patent Publication No. Sho 62-10355) is shown in FIG. 6.

That is, pipes 5 through which a working medium passes are disposed in rows 7 in a direction perpendicular to a gas flow accompanied by a flame 3 from a combustion burner 1. A plurality of such pipe rows 7 are arranged in a direction of the flame 3 to form a group of pipes. The pipes 5 of the group consist of pipes 5A arranged at the immediate downstream of the flame of the combustion burner and provided with no fin and pipes 5B arranged at the farther downstream of the flame and provided with a fin. Rectifying plates 11 are provided on the wall 9 of the combustion furnace. Since the rectifying plates 11 are installed in an useless space 13 devoid of the pipes at both ends of each pipe row, the space 13 is intended to prevent a heat loss caused by the short-passing of the combustion gas.

However, in the high-temperature regenerator of the prior art which uses a group of pipes and a combustion burner 1, since a combustion gas flow is cooled rapidly by its contact with the group of pipes, it is likely the combustion is not completed and an unburnt gas is exhausted as highly toxic carbon monoxide.

SUMMARY OF THE INVENTION

An object of this invention which has been made to solve the above problems is to provide a high-temperature regenerator in which combustion is completed and an unburnt gas is hardly exhausted.

To attain the above object, a first aspect of the invention is a high-temperature regenerator for heating a working medium circulating in an absorption type refrigerator to evaporate a refrigerant absorbed in an absorption solution contained in the working medium, which comprises a group of pipes for passing the working medium which are disposed in a combustion furnace and spaced apart from one another, a combustion burner for causing a combustion gas to flow between the pipes of the group of pipes, and partition plates, provided in a high-temperature region of a combustion gas flow, for causing the combustion gas flow to make a loop detour and stay in the region.

A second aspect of the invention is a high-temperature regenerator according to the first aspect, wherein the group of pipes are formed by arranging in a direction of a flame a plurality of pipe rows disposed in a direction perpendicular to the flame direction of the combustion burner, the partition plates consist of first and second partition plates, the first and the second partition plates are formed by arranging plate parts between the pipes of pipe rows or between pipe rows, the first partition plate is provided at the downstream of the flame of the combustion burner and has the same or larger width than the width of the flame, and the second partition plates are arranged in a zigzag form at the downstream of the first partition plate for causing the combustion gas flow to make a loop detour.

A third aspect of the invention is a high-temperature regenerator according to the second aspect, wherein a residence area for causing the combustion gas flow to stay therein is formed large by a space devoid of the pipes at the downstream of the first partition plate.

A fourth aspect of the invention is a high-temperature regenerator according to the first aspect, wherein a plurality of the partition plates are arranged in a zigzag form.

A fifth aspect of the invention is a high-temperature regenerator according to the fourth aspect, wherein a plurality of the partition plates are arranged in a substantially horizontal direction in a zigzag form by installing some on a top portion of the combustion furnace and others on a bottom portion of the combustion furnace alternately.

A sixth aspect of the invention is a high-temperature regenerator according to the fifth aspect, wherein the group of pipes are formed by arranging in a direction of the flame a plurality of pipe rows disposed in a direction perpendicular to the direction of the flame of the combustion burner and the partition plates are provided between pipe rows.

A seventh aspect of the present invention is a high-temperature regenerator according to the fifth aspect, wherein the group of pipes are formed by arranging in a direction of the flame a plurality of pipe rows disposed in a direction perpendicular to the direction of the flame of the combustion burner and the partition plates are formed by arranging plate parts between the pipes of pipe rows.

An eighth aspect of the invention is a high-temperature regenerator according to the fifth aspect, wherein the group of pipes are formed by arranging in a direction of the flame a plurality of pipe rows disposed in a direction perpendicular to the direction of the flame of the combustion burner, the plurality of partition plates are arranged in parallel to pipes, and there are a small number of pipes of the group of pipes between the partition plates.

A ninth aspect of the invention is a high-temperature regenerator according to the fifth aspect, wherein the group of pipes are formed by arranging in a direction of the flame a plurality of pipe rows disposed in a direction perpendicular to the direction of the flame of the combustion burner, the plurality of partition plates are arranged in parallel to pipes, and there are no pipes between the partition plates.

The above and other objects and advantages of the present invention will become clear from the following description with reference to the accompanying drawings.

BRIEF DESCRIPTION OF THE DRAWINGS

FIGS. 1(A) and 1(B) show a first embodiment of the present invention, wherein FIG. 1(A) is a horizontal sectional view and FIG. 1(B) is a side view thereof;

FIGS. 2(A) and 2(B) show a second embodiment of the present invention, wherein FIG. 2(A) is a horizontal sectional view and FIG. 2(B) is a side view thereof;

FIGS. 3(A) and 3(B) show a third embodiment of the present invention, wherein FIG. 3(A) is a horizontal sectional view and FIG. 3(B) is a side view thereof;

FIGS. 4(A) and 4(B) show a fourth embodiment of the present invention, wherein FIG. 4(A) is a horizontal sectional view and FIG. 4(B) is a side view thereof;

FIGS. 5(A) and 5(B) show a fifth embodiment of the present invention, wherein FIG. 5(A) is a horizontal sectional view and FIG. 5(B) is a side view thereof.

DETAILED DESCRIPTION OF THE PREFERRED EMBODIMENTS

Figure 1A:
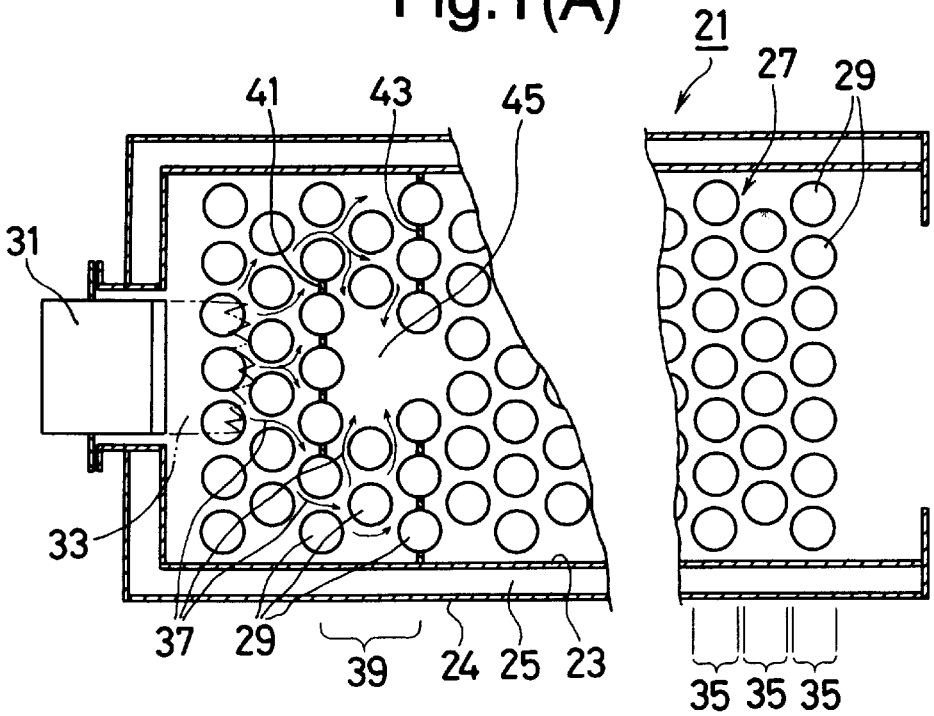
Figure 1B:
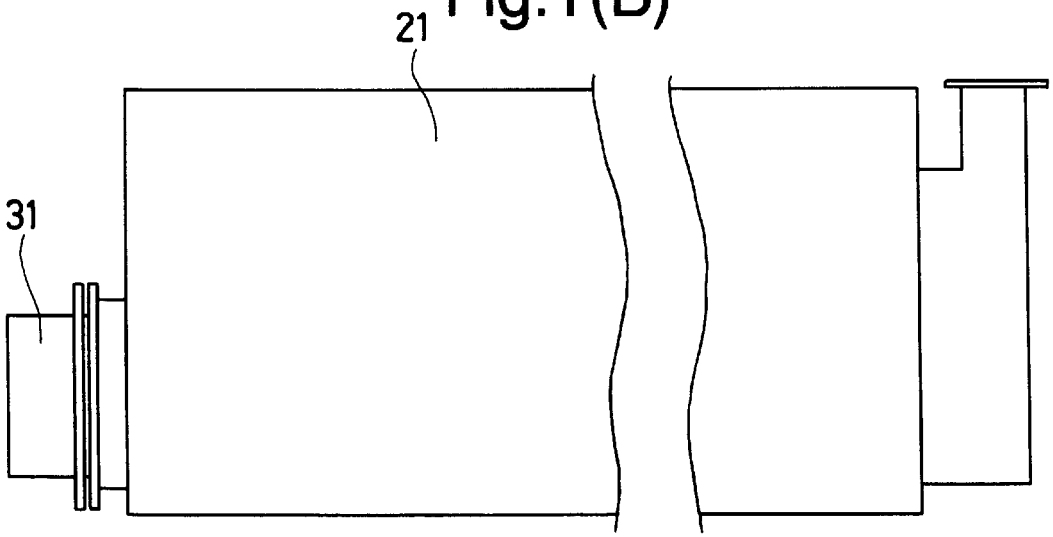

An embodiment of the present invention is described hereinunder with reference to FIG. 1.

A high-temperature regenerator is an apparatus for heating a working medium circulating in an absorption type refrigerator to evaporate a refrigerant absorbed in an absorption solution contained in the working medium. The combustion furnace 21 of a high-temperature regenerator according to this embodiment is formed inside a furnace wall 23. There are the furnace wall 23 and an exterior wall 24 formed outside the furnace wall 23, and a working medium 25 flows between them. Thereby, the working medium 25 is preheated. The preheated working medium 25 is caused to pass through a group 27 of pipes in the combustion furnace 21. The group 27 of pipes are formed by arranging pipes 29 for passing the working medium therethrough such that they are spaced apart from one another.

The combustion furnace 21 is laid sideways and a combustion burner 31 is arranged such that the blowout direction of a flame 33 becomes a horizontal direction. The pipes 29 are disposed in a direction perpendicular to the direction of the flame 33 of the combustion burner 31 and in a vertical direction. The pipes 29 are arranged in the direction perpendicular to the direction of the flame 33 to form pipe rows 35. The group 27 of pipes are formed by arranging a plurality of the pipe rows 35 in the direction of the flame 33.

In a high-temperature region 39 where the temperature of the combustion gas flow 37 following the flame 33 is 1,200° to 1,000° C., a first and a second partition plates 41 and 43 are provided in parallel to the pipes 29 and in a direction perpendicular to the direction of the flame 33 from the combustion burner 31. These partition plates 41 and 43 are formed by installing long and narrow plate parts between adjacent pipes 29 of pipe rows 35. Out of these partition plates, the first partition plate 41 is provided at the immediate downstream of the flame 33 of the combustion burner 31 and has the same or larger width than the width of the flame. The vertical length of the first partition plate 41 is the same as the vertical length of the inside of the combustion furnace 21. It is possible to make the vertical length of the first partition plate 41 smaller than the vertical length of the inside of the combustion furnace 21. Alternatively, a space may be provided partially in a vertical direction.

The second partition plates 43 are provided at the farther downstream of the flame than the first partition plate 41. Two second partition plates 43 are provided to cover from right and left walls 23 of the combustion furnace to an intermediate portion of the combustion furnace so as to receive the combustion gas flow 37 which is divided into right and left directions by the first partition plate 41 and let it make a loop detour. The second partition plates 43 are disposed in a zigzag form at the downstream side of the first partition plate 41.

There is a single pipe row 35 between the first and second partition plates 41 and 43. A space 45 devoid of the pipes 29 is formed in the center of the pipe row 35 to form a residence area for causing the combustion gas flow 37 to stay therein.

In the above embodiment, the flame 33 of the combustion burner 31 is received by the first partition plate 41, divided into right and left directions, and then received by the second partition plates 43. Thereby, the flame 33 and the combustion gas 37 are guided by the two second partition plates 43 and flow in a loop form in the end.

The combustion gas flow 37 makes a loop detour and its residence is promoted because the flow is not straight. In the residence area (45) formed between the two second partition plates 43 at the downstream of the first partition plate 41, the residence of the combustion gas flow 37 is further promoted.

Since the combustion gas flow 37 runs in a loop form and stays in this way, its residence time in the high-temperature region 39 is prolonged, whereby the combustion is completed and the exhaust of an unburnt gas can be suppressed. In other words, the amounts of carbon monoxide and NOx generated can be reduced. For instance, the amount of NOx generated is 20 to 30 ppm.

By the completion of the combustion, combustion efficiency is increased and the size of a high-temperature regenerator can be thereby reduced. When a burner into which a combustion gas and air preliminary mixed are introduced is used as the combustion burner 31, the capacity thereof can be reduced and the combustion sound is minimized, whereby noise can be reduced.

In the above first embodiment, the combustion gas flow 37 is divided into right and left directions by the first partition plate 41 having a larger width than the width of the flame and make a loop detour. In another embodiment described below (FIGS. 2 to 5), the combustion gas flow 37 may run in upper and lower directions to make a loop detour by a plurality of partition plates 51 disposed in a zigzag form.

Figure 2A:
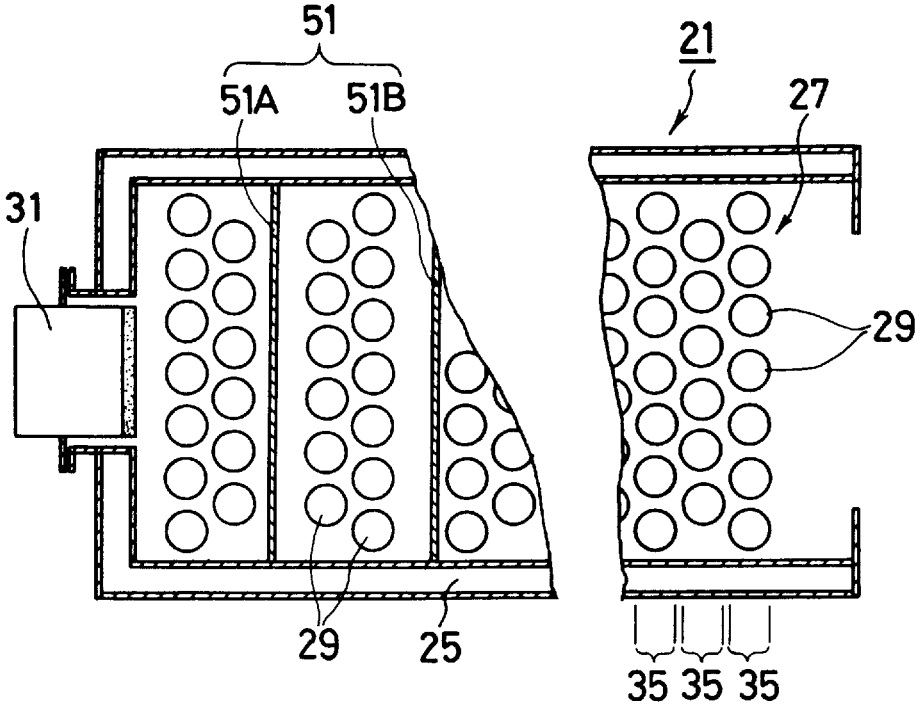
Figure 2B:
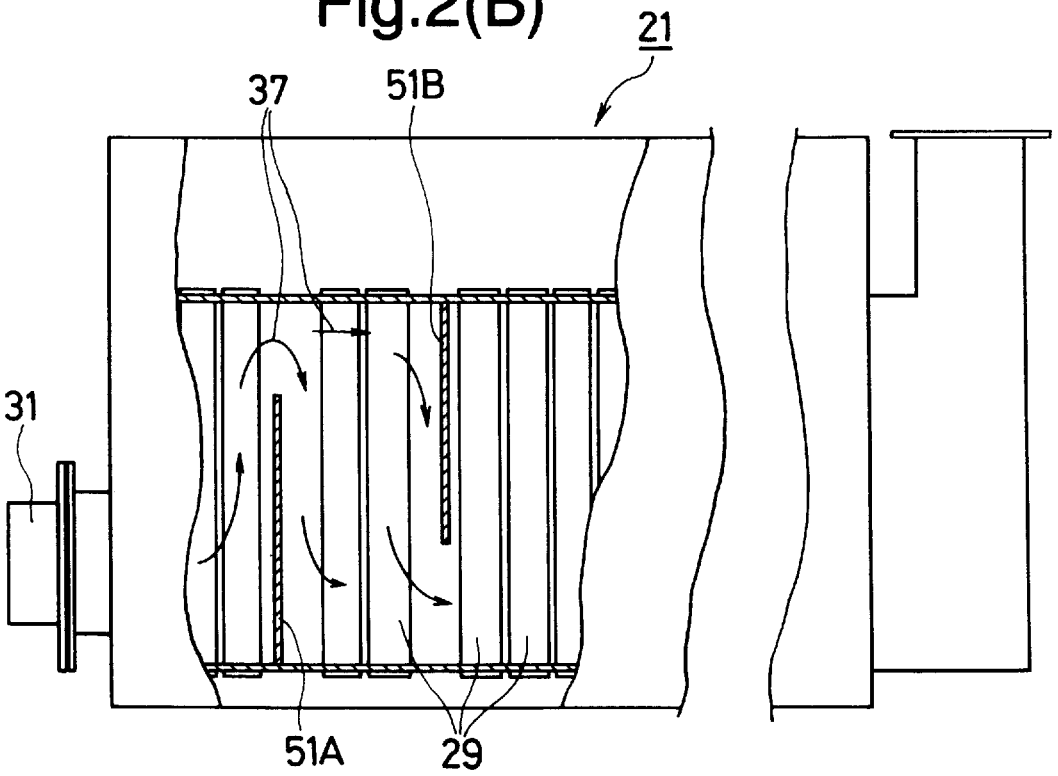

In other words, as shown in FIG. 2, a plurality of partition plates 51 have the same width in a horizontal direction as the total width of the combustion furnace and a smaller vertical length than the vertical length of the combustion furnace. The plurality of partition plates 51 are arranged sequentially in a substantially horizontal direction, that is, in a direction from the combustion burner 31 to the flame and the combustion gas flow. Some of the partition plates are installed on a bottom portion of the combustion furnace in a vertical direction and the others are installed on a top portion of the combustion furnace in a vertical direction. Partition plates 51B installed on a bottom portion of the combustion furnace and partition plates installed on a top portion of the combustion furnace are arranged alternately in a zigzag form. Each of the partition plates 51 is provided between the pipe rows 35.

According to this second embodiment, the flame 33 of the combustion burner 31 and the combustion gas flow 37 are received by the first partition plate 51A, detour upward, run into an upper portion of the combustion furnace, are received by the second partition plate 51B installed on a top portion of the combustion furnace, and detour downward.

Thus, the combustion gas flow 37 runs in a loop form in a vertical direction.

Even in the constitution of this embodiment, since the combustion gas flow 37 runs in a loop form in a vertical direction as shown by arrows in FIG. 2 and its residence time can be prolonged, the same effects as those of the first embodiment can be obtained.

Figure 3A:
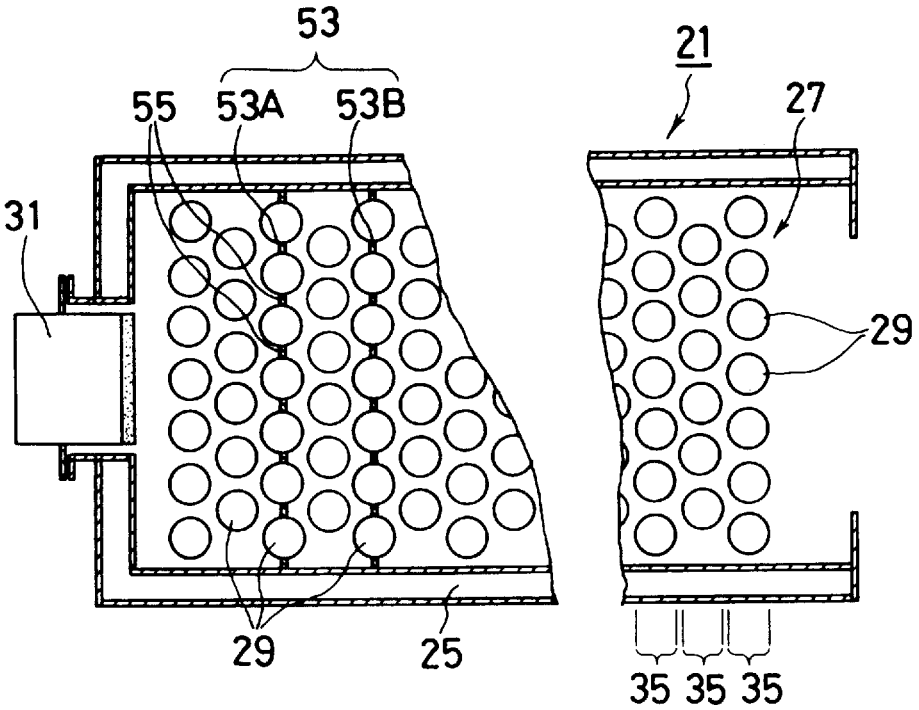
Figure 3B:
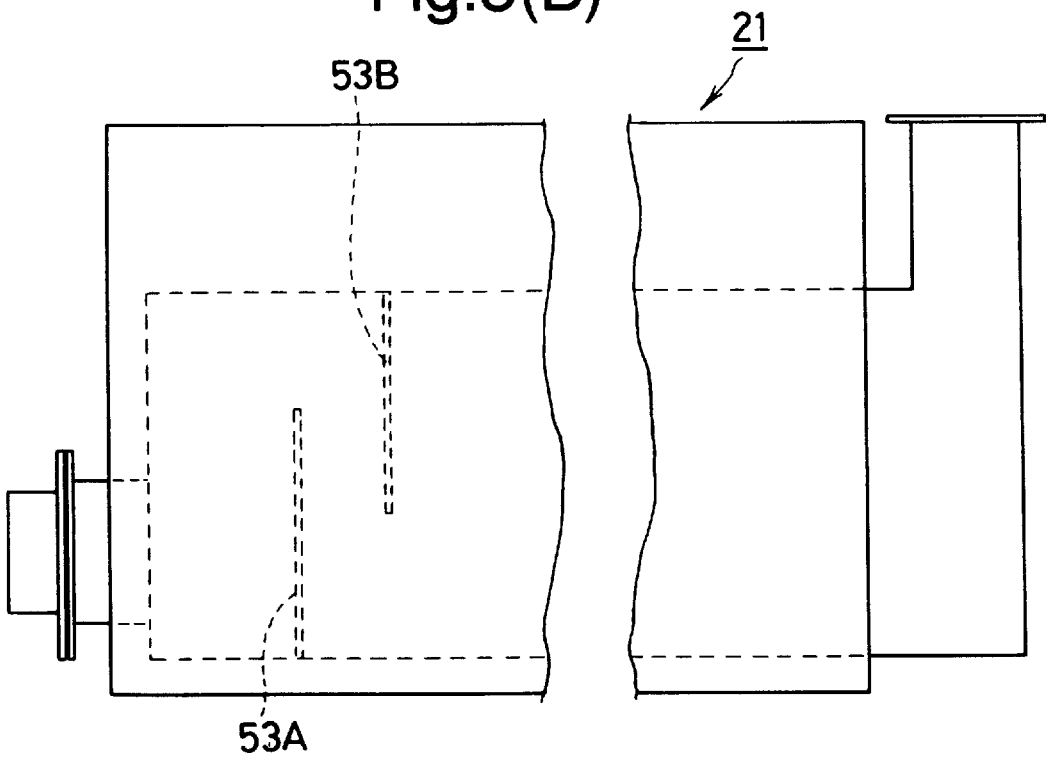

According to a third embodiment shown in FIG. 3, the partition plates 53A and 53B may be provided by installing a long and narrow plate part 55 between pipes 29 of a pipe row 35 and connecting it to each pipe 29.

Figure 4A:
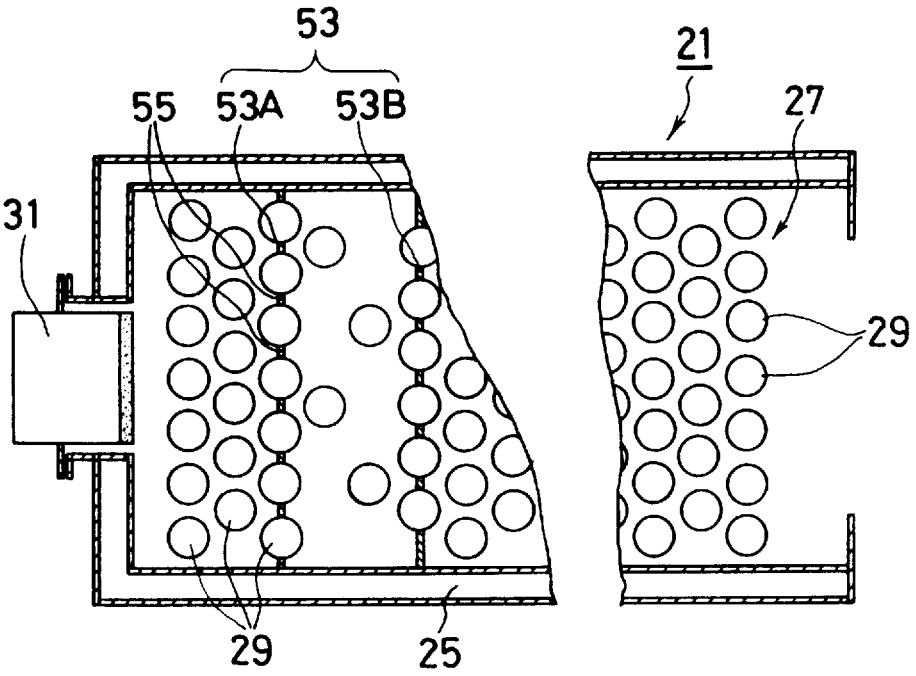
Figure 4B:
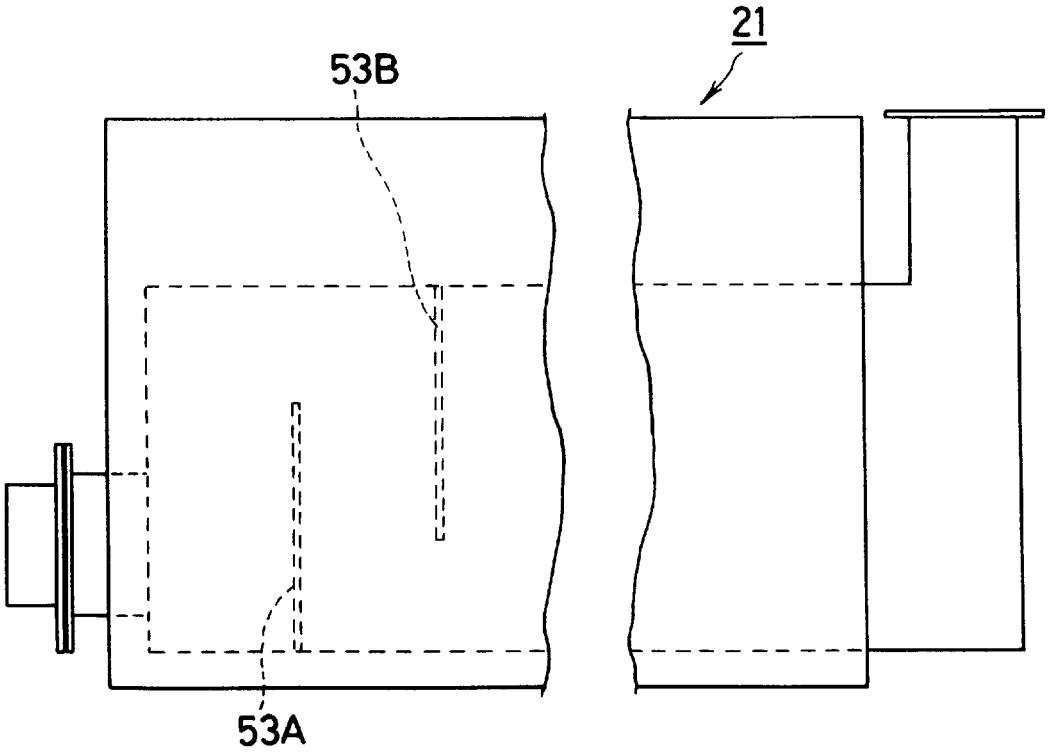

According to a fourth embodiment shown in FIG. 4, a group 27 of a small number of pipes 29 may be arranged between the partition plates 53A and 53B at a low density. Thus, the residence area of the combustion gas flow 37 (see FIG. 1) can be made wide and combustion can be further promoted by arranging the group 27 of pipes at a low density.

Figure 5A:
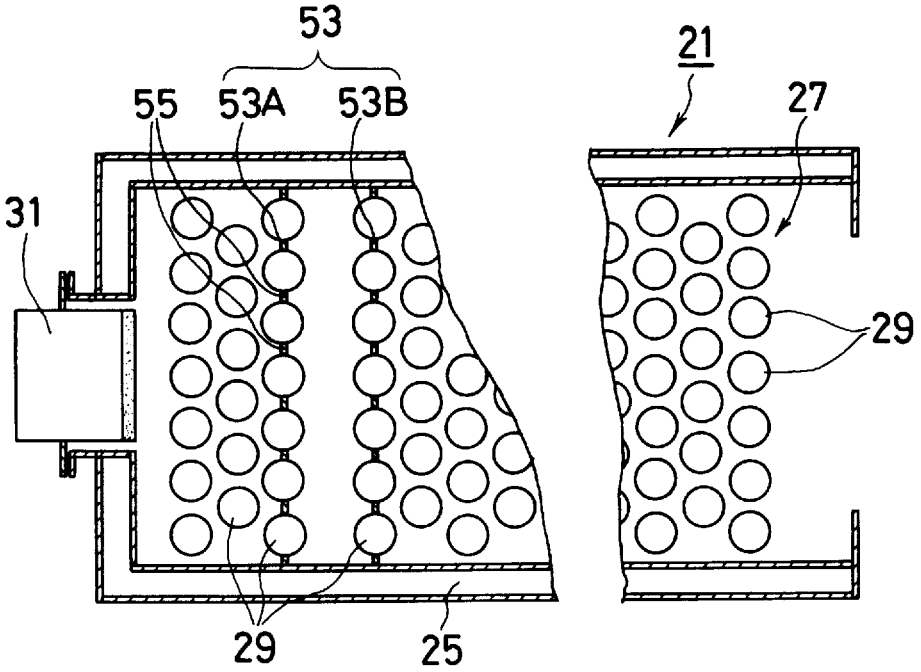
Figure 5B:
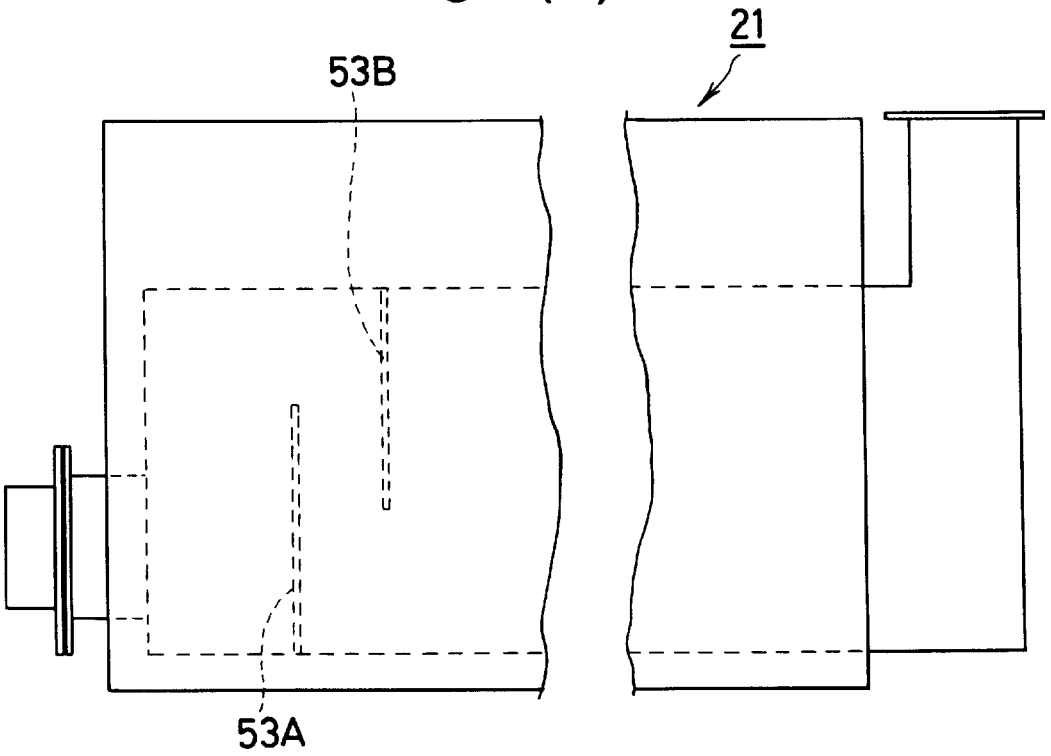
Figure 6:
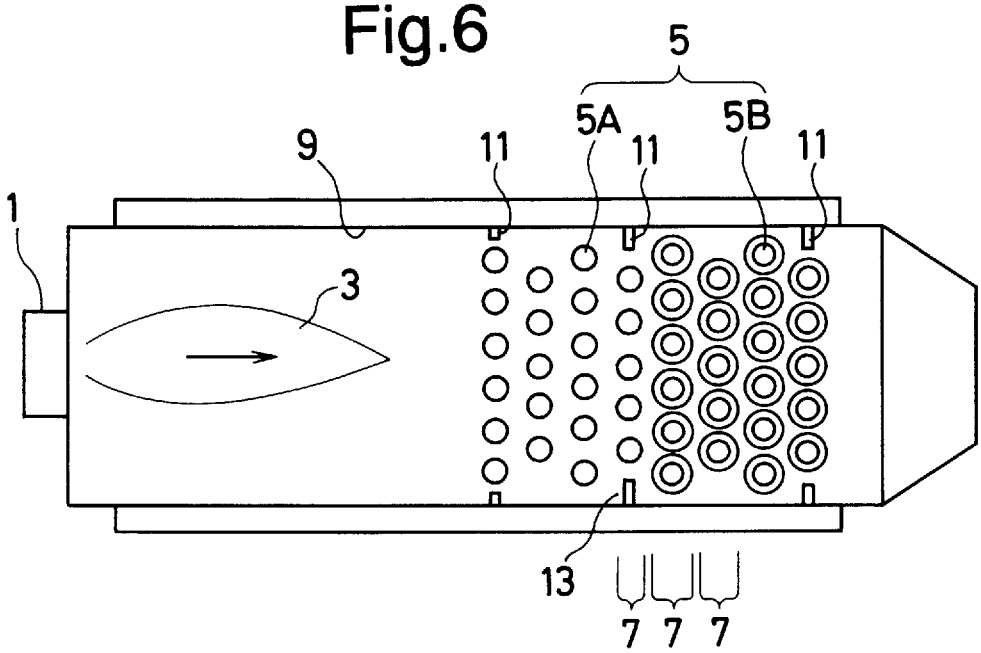
Prior Art Fig.6
FIG. 6 is a horizontal sectional view of the prior art.

According to a fifth embodiment shown in FIG. 5, no pipes 29 may be provided between the partition plates 53A and 53B. Thus, the residence area of the combustion gas flow 37 (see FIG. 1) can be made wider.

Like the above third and fourth embodiments, the residence area is made wide in the high-temperature region, whereby it is possible to prevent the combustion gas flow from being cooled by the group 27 of pipes and to promote combustion.

While the partition plates 53 are connected between pipes 29 and 29 in these third and fourth embodiments, a single partition plate (see FIG. 2) may be provided between pipe rows 35 and 35 according to another embodiment.

As described above, since the high-temperature regenerator of the present invention makes it possible to cause a combustion gas flow to make detours to run in a loop form and stay in a high-temperature region for the combustion gas flow, it is possible to complete combustion with ease and to make it difficult to exhaust an unburnt gas. In other words, the amounts of carbon monoxide and NOx generated can be reduced. Owing to a high combustion efficiency, the size of the high-temperature regenerator can be reduced.

What is claimed is:

1. A high-temperature regenerator for heating a working medium circulating in an absorption type refrigerator to evaporate a refrigerant absorbed in an absorption solution contained in the working medium, comprising:

a group of pipes for passing the working medium which are disposed in a combustion furnace and spaced apart from one another;

a combustion burner for causing a combustion gas to flow between the pipes of the group of pipes; and partition plates, provided in a high-temperature region of a combustion gas flow for increasing the residence time of combustion products, a plurality of the partition plates being arranged in a substantially horizontal direction in a zigzag form by installing some on a top portion of the combustion furnace and others on a bottom portion of the combustion furnace alternately;

wherein the group of pipes are formed by arranging in a direction of the flame a plurality of pipe rows disposed in a direction perpendicular to the direction of the flame of the combustion burner, the plurality of partition plates are arranged in parallel to pipes, and there are no pipes between the partition plates.

* * * * *

UNITED STATES PATENT AND TRADEMARK OFFICE

CERTIFICATE OF CORRECTION

PATENT NO. : 5,771,711

DATED : June 30, 1998

INVENTOR(S) : Norikazu Kubota

It is certified that error appears in the above-indentified patent and that said Letters Patent is hereby corrected as shown below:

On the title page, under item [56], insert:

FOREIGN APPLICATION PRIORITY DATA:
March 1, 1996 [JP] Japan 8-44698

Signed and Sealed this

Ninth Day of November, 1999

*Attest:*

*Attesting Officer*

Q. TODD DICKINSON

*Acting Commissioner of Patents and Trademarks*